United States Patent [19]

Ono

[11] Patent Number: 4,669,351

[45] Date of Patent: Jun. 2, 1987

[54] WOODWIND INSTRUMENT

[75] Inventor: Hirotaka Ono, Tokyo, Japan

[73] Assignee: Toyama Gakki Seizo K.K., Tokyo, Japan

[21] Appl. No.: 636,737

[22] Filed: Aug. 1, 1984

[30] Foreign Application Priority Data

Aug. 8, 1983 [JP] Japan ..... 58-122225[U]
Aug. 8, 1983 [JP] Japan ..... 58-122226[U]

[51] Int. Cl.[4] ..... G10D 7/00

[52] U.S. Cl. ..... 84/380 R; 84/382; 84/384

[58] Field of Search ..... 84/380–386

[56] References Cited

U.S. PATENT DOCUMENTS 329,940 11/1885 Oesterle ..... 84/380
1,844,242 2/1932 Ciccone ..... 84/385
2,330,379 9/1943 Powell ..... 84/384
2,471,290 5/1949 Sommaruga ..... 84/385
3,657,464 4/1972 Pascucci ..... 84/380

*Primary Examiner*—Lawrence R. Franklin
*Attorney, Agent, or Firm*—Frishauf, Holtz, Goodman & Woodward

[57] ABSTRACT

In a woodwind instrument of the type which opens a tone hole by means of the combination of a key and an arm having a tone hole cover at one end both supported by a pair of posts via a hinge rod, a woodwind instrument comprises a pair of bases respectively projecting from the outer periphery of an instrument body and adapted to support a pair of posts. Each of said bases is formed with a hole of sufficient depth so that proper securement of the posts to the instrument body may be obtained upon fitting the lower portion of each of the posts to the corresponding respective hole therein.

16 Claims, 9 Drawing Figures

WOODWIND INSTRUMENT

BACKGROUND OF THE INVENTION

1. Field of the Invention

The present invention relates to the field of woodwind musical instruments and more particularly, to a structure of an instrument body which enables proper securement of posts thereto and proper alignment of a tone hole cover with a tone hole.

2. Description of the Prior Art

There is shown in FIG. 1 a woodwind instrument 1 of the type which opens a tone hole 2 by means of the combination of a key 3 and an arm 4 having a tone hole cover 5 at one end both supported by a pair of posts 6 via a hinge rod 7. Heretofore, the posts 6 are threadably secured directly to the outer peripheral surface of an instrument body 8 as shown in FIG. 2. Specifically, a pair of holes 9 are formed in the instrument body 8 and each hole 9 is intended to receive a corresponding externally threaded lower portion 10 of each of the posts 6 for engagement therewith. In this manner, however, naturally, the length l of each of the externally threaded lower portions can not be greater than the thickness t of the instrument body 8, causing less securement of the posts 6 thereto. Consequently, the posts 6 may not properly be positioned against the instrument body 8, resulting in malfunction of the key 3 and misalignment of the tone hole cover 5 with the tone hole 2.

Furthermore, in the event that posts are secured to portions of different thickness as shown in FIG. 3, a thinner portion requires a longer post 6*a* than the other post 6*b* in that the longitudinal axis of the hinge rod 7 must be parallel to that of an instrument body 1*a* for proper alignment of the tone hole cover 5 with the tone hole 2. As is clear in FIG. 3, the longer post 6*a* is more subject to release from the instrument body 1*a* than the above-mentioned case due to less securement thereof to the instrument body 1*a*.

SUMMARY OF THE INVENTION

It is therefore the primary object of the present invention to provide a woodwind instrument which enables proper securement of posts to an instrument body.

It is another object of the present invention to provide a woodwind instrument in accordance with the preceding object and which enables proper function of a key and proper alignment of a tone hole cover with a tone hole.

BRIEF DESCRIPTION OF THE DRAWINGS

Other objects and advantages of the present invention will be more apparent from the following detailed description taken in conjunction with the accompanying drawings, in which.

THE PREFERRED EMBODIMENTS OF THE INVENTION

Figure 1:
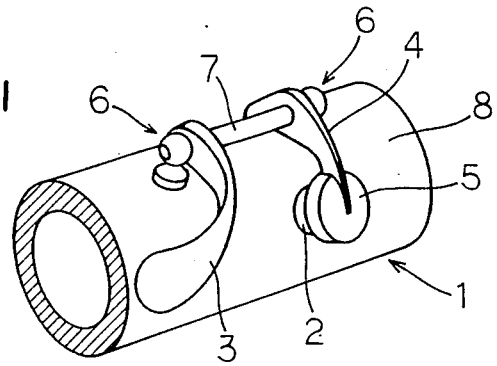
FIG.1 (PRIOR ART)
FIG. 1 is a fragmentary view in perspective of an instrument body to which a pair of posts are secured in a conventional manner.
Figure 2:
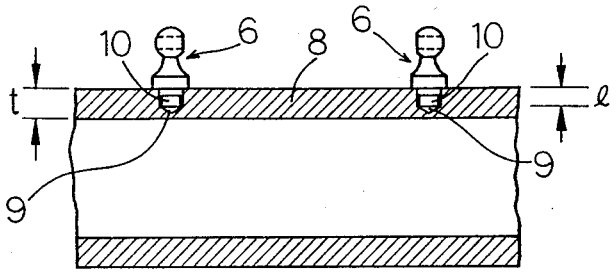
FIG.2 (PRIOR ART)
FIG. 2 is a sectional view taken substantially longitudinally through the center of the instrument body illustrated in FIG. 1.
Figure 3:
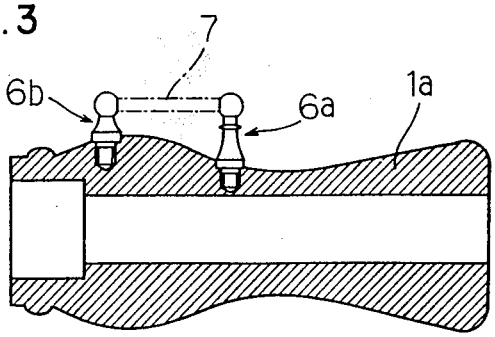
FIG.3 (PRIOR ART)
FIG. 3 is a similar fragmentary sectional view to FIG. 2, but showing an instrument body of different configuration to which posts of different height are secured in a conventional manner.
Figure 4:
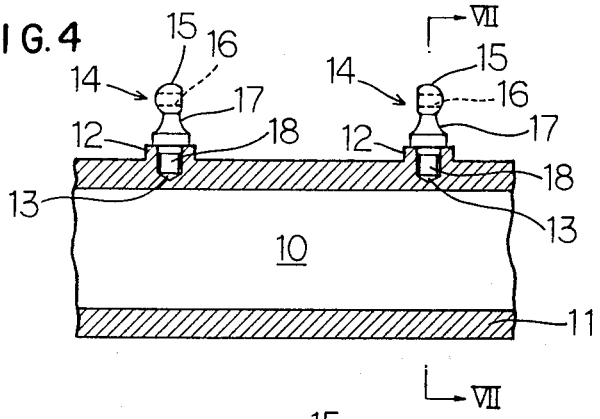
FIG. 4 is a fragmentary sectional view of an instrument body to which a pair of posts are secured according to one embodiment of the present invention.
Figure 5:
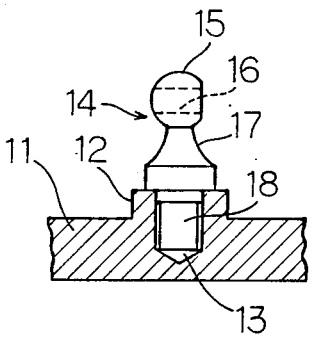
FIG. 5 is a fragmentary sectional view, on an enlarged scale, of an integral part of FIG. 1.

A woodwind instrument 10 of the present invention, and one embodiment thereof which is illustrated in FIG. 4, includes a substantially cylindrical hollow instrument body 11 wherein a pair of bases 12 respectively project radially outwardly from the outer periphery thereof. Each of the bases 12 is formed with an internally threaded hole 13. Mounted on the upper surface of each of the bases 12 is a past 14. Each post 14 includes a substantially ball-shaped upper portion 15 with a horizontally extending through hole 16, a substantially tapered outer peripheral middle portion 17 and an externally threaded lower portion 18. In this embodiment, each post 14 is threadably secured to the respective hole 13 in the instrument body 11 upon engagement of the internally threaded hole 13 with the externally threaded lower portion 18. In this construction, the thickness of the instrument body 11 is increased at portions on which the radially outwardly projecting bases 12 are formed. Thus, a sufficient length of posts may be employed, thereby to obtain proper securement of the posts to the instrument body 11. Further, it will be noted that the axis of the through hole 16 is in alignment with that of the other through hole 16, requiring no further key adjustment.

Figure 6:
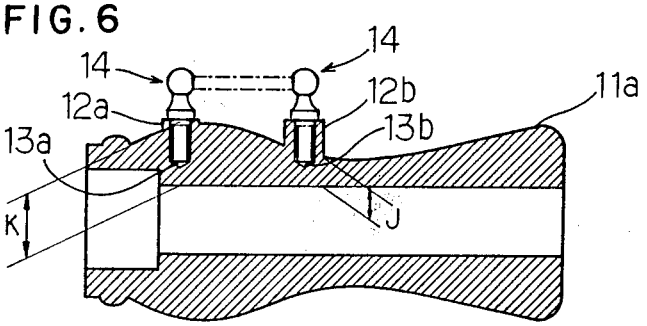
FIG. 6 is a similar fragmentary sectional view to FIG. 4, but showing an instrument body of different configuration to which a pair of posts are secured according to another embodiment of the present invention.

With reference to FIG. 6, there is shown an instrument body 11*a* according to another embodiment of the invention wherein a pair of posts 14 are threadably secured respectively to holes 13*a*, 13*b*. In this embodiment, a longer base 12*b* is integrally formed at a thin portion J of the instrument body 11*a* while a shorter base 12*a* is integrally formed at a thick portion K thereof. Thus, the holes 13*a*, 13*b* formed respectively at the thin and thick portions will have the same depth and proper securement of both posts 14 to the instrument body 11*a* may be obtained.

Figure 7:
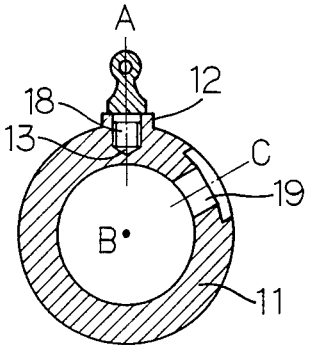
FIG. 7 is a sectional view taken along the line VII—VII of FIG. 4 and showing the instrument body wherein a hole is formed in the instrument body in such a way that the axis thereof is given in an intersecting relation to the central axis of the instrument body.
Figure 9:
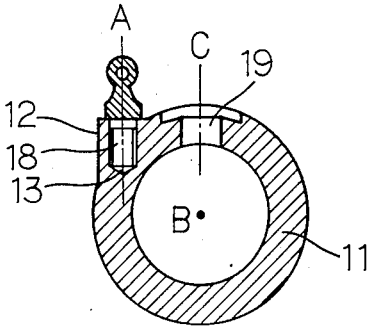
FIG. 9 is a similar view to FIGS. 7 and 8, but showing the instrument body wherein the hole is formed in the instrument body in such a way that the axis thereof is given in any direction except for intersecting the central axis of the instrument body while being in a parallel relation to the axis of a tone hole.
Figure 8:
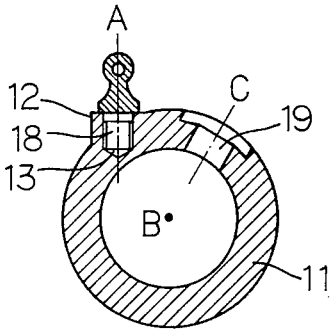
FIG. 8 is a similar view to FIG. 7, but showing the instrument body wherein the hole is formed in the instrument body in such a way that the axis thereof is given in any direction except for intersecting the central axis of the instrument body.

FIGS. 7 and 9 show other embodiments of the present invention. In the embodiment as shown in FIG. 7, each hole 13 is formed in the instrument body 11 in such a way that the axis A thereof is given in an intersecting relation to the central axis B of the instrument body 11. In the embodiment as shown in FIG. 8, each hole 13 is formed in the instrument body 11 in such a way that the axis A thereof may be given in any direction except for intersecting the central axis B of the instrument body 11. Further, in the embodiment as shown in FIG. 9, each hole 13 is formed in the instrument body 11 in such a way that the axis A thereof may be given in any direction except for intersecting the central axis B of the instrument body 11 while being in a parallel relation to the axis C of a tone hole 19. In this particular embodiment, since the axis of each of the holes is in a parallel relation to the axis of the tone hole 19, each of the posts 14 made of metal may be integrally fitted within the instrument body 11 when the instrument body 11 made of synthetic resin is formed to a predetermined configuration by means of injection molding. Namely, the posts 14 are previously arranged within an injection mold (not shown) and thereafter an injection molding material is injected into the injection mold thereby to integrally form the instrument body 11 with the posts 14.

It will be appreciated that a number of modifications to the present invention may be apparent to those skilled in the art without departing from the spirit and scope thereof, and it is intended that the present invention be defined only by the scope of the following claims.

What is claimed is:

1. In a woodwind instrument of the type having an instrument body made of synthetic materials by means of a molding process; said instrument body having a longitudinal axis and at least one undulating outer peripheral surface portion over which said instrument body has different outer diameter, and tone holes which are selectively opened and closed by means of the combination of a key and an arm having a tone hole cover at one end; said arm and said tone hole cover both being supported by a pair of posts via a hinge rod extending between and supported by said pair of posts;

the improvement comprising:

a plurality of pairs of bases integrally molded on said instrument body, the bases of a pair of said bases extending over an undulating outer peripheral surface portion of said instrument body and having substantially the same size and shape for any portion of said undulating outer peripheral surface portion of said instrument body, said pairs of bases projecting outwardly from said instrument body in a substantially integral manner, the bases of said respective pairs of bases having tops which lie in the same plane for supporting a pair of posts, respectively, so that a hinge rod supported by said pair of posts extends substantially parallel to said longitudinal axis of said instrument body, said bases further being provided with holes therein for receiving lower ends of said posts, said holes being sufficiently deep to securely mount said lower ends of said posts to said instrument body.

2. The woodwind instrument of claim 1, wherein said tops of at least a plurality of said bases lie in the same plane as said longitudinal axis of said instrument body.

3. The woodwind instrument of claim 1, wherein said holes in said bases are blind holes.

4. The woodwind instrument of claim 1, wherein said holes in said bases are threaded bores with an internal thread, and said lower portion of each of said posts is formed with an external thread which is threadably engagable in said internally threaded bores of said bases, whereby said lower portions of said posts are threadably secured to respective holes in said bases of said instrument body.

5. The woodwind instrument of claim 4, wherein said holes in said bases are blind holes.

6. The woodwind instrument of claim 4, wherein at least a plurality of said holes in said bases have respective axes which intersect with said longitudinal axis of said instrument body.

7. The woodwind instrument of claim 4, wherein at least a plurality of said holes of said bases are formed so as not to intersect with said longitudinal axis of said instrument body.

8. The woodwind instrument of claim 7, wherein said holes which have axes which do not intersect with said longitudinal axis of said instrument body have axes which are substantially in parallel to an axis of an associated tone hole of said instrument.

9. The woodwind instrument of claim 1, wherein said instrument body is injection molded of a synthetic resin, and wherein said posts are made of metal.

10. The woodwind instrument of claim 9, wherein said metal posts are previously arranged within an injection mold before molding of said instrument body so as to be integrally fitted within said instrument body when it is molded.

11. The woodwind instrument of claim 10, wherein at least a plurality of said holes in said bases have respective axes which intersect with said longitudinal axis of said instrument body.

12. The woodwind instrument of claim 10, wherein at least a plurality of said holes of said bases are formed so as not to intersect with said longitudinal axis of said instrument body.

13. The woodwind instrument of claim 12, wherein said holes which have axes which do not intersect with said longitudinal axis of said instrument body have axes which are substantially in parallel to an axis of an associated tone hole of said instrument.

14. The woodwind instrument of claim 1, wherein at least a plurality of said holes in said bases have respective axes which intersect with said longitudinal axis of said instrument body.

15. The woodwind instrument of claim 1, wherein at least a plurality of said holes of said bases are formed so as not to intersect with said longitudinal axis of said instrument body.

16. The woodwind instrument of claim 15, wherein said holes which have axes which do not intersect with said longitudinal axis of said instrument body have axes which are substantially in parallel to an axis of an associated tone hole of said instrument.

* * * * *